US007152946B2

(12) United States Patent
Desie

(10) Patent No.: US 7,152,946 B2
(45) Date of Patent: Dec. 26, 2006

(54) METHOD AND DEVICE FOR PRINTING GREY SCALE IMAGES AT HIGH PRINTING SPEED AND IMAGE QUALITY

(75) Inventor: Guido Desie, Herent (BE)

(73) Assignee: Agfa-Gevaert, Mortsel (BE)

( * ) Notice: Subject to any disclaimer, the term of this patent is extended or adjusted under 35 U.S.C. 154(b) by 320 days.

(21) Appl. No.: 10/783,139

(22) Filed: Feb. 20, 2004

(65) Prior Publication Data

US 2004/0165021 A1 Aug. 26, 2004

Related U.S. Application Data

(60) Provisional application No. 60/451,612, filed on Mar. 3, 2003.

(30) Foreign Application Priority Data

Feb. 21, 2003 (EP) ..... 03100424

(51) Int. Cl.
*B41J 2/15* (2006.01)

(52) U.S. Cl. ..... 347/41; 347/15; 358/1.9

(58) Field of Classification Search ..... 347/41, 347/15; 358/1.9

See application file for complete search history.

(56) References Cited

U.S. PATENT DOCUMENTS 4,714,935 A 12/1987 Yamamoto et al.
5,581,284 A 12/1996 Hermanson
5,587,730 A 12/1996 Karz
6,375,294 B1 4/2002 Kneezel
2002/0105557 A1 8/2002 Teshigawara et al.
2004/0223014 A1* 11/2004 Barr et al. ..... 347/12

FOREIGN PATENT DOCUMENTS

EP 0 902 587 A2 3/1999
EP 0 914 954 A1 5/1999
EP 1 228 878 A1 8/2002
EP 03 10 0424 7/2003

* cited by examiner

*Primary Examiner*—Lamson Nguyen
(74) *Attorney, Agent, or Firm*—Robert A. Sabourin

(57) ABSTRACT

The present invention relates to ink jet printing, and more particularly to a method of printing and an apparatus for providing images having grey levels of varying intensity.

The present invention provides a method and device for printing grey scale images on a printing medium. The method includes delivering at least a number of first droplets of printing material of a color with a first volume from a first printhead and a number of second droplets of printing material of that color with a second volume from a second printhead, the first volume and the second volume being different, and merging together the number of first droplets and the number of second droplets on a target pixel position on the printing medium to obtain a given greyscale dot on the printing medium.

10 Claims, 2 Drawing Sheets

METHOD AND DEVICE FOR PRINTING GREY SCALE IMAGES AT HIGH PRINTING SPEED AND IMAGE QUALITY

The application claims the benefit of U.S. Provisional Application No. 60/451,612 filed Mar. 3, 2003.

FIELD OF THE INVENTION

The present invention relates to ink jet printing, and more particularly to a method of printing and an apparatus for providing images having grey levels of varying intensity. With grey levels is meant black/white/grey and/or colour levels of varying intensity.

BACKGROUND OF THE INVENTION

Printing is one of the most popular ways of conveying information to members of the general public. Digital printing using raster printers allows rapid printing of text and graphics stored on computing devices such as personal computers. These printing methods allow rapid conversion of ideas and concepts to printed product at an economic price without time consuming and specialised production of intermediate printing plates such as lithographic plates. The development of digital printing methods has made printing an economic reality for the average person even in the home environment.

Conventional methods of raster printing often involve the use of a printhead, e.g. an ink jet printhead, with a plurality of marking elements, e.g. ink jet nozzles. The marking elements transfer a marking material, e.g. ink or resin, from the printhead to a printing medium, e.g. paper or plastic. The printing may be monochrome, e.g. black, or multi-coloured, e.g. full colour printing using a CMY (cyan, magenta, yellow, black=a process black made up of a combination of C, M, Y), a CMYK (cyan, magenta, yellow, black), or a specialised colour scheme (e.g. CMYK plus one or more additional spot or specialised colours). To make a print on a printing medium such as paper or plastic, the marking elements are "fired" in a specific order while the printing medium is moved relative to the marking elements. Each time a marking element is fired, marking material, e.g. ink, is transferred to the printing medium by a method depending on the printing technology used. Typically, in one form of printer, the head will be moved relative to the printing medium to produce a so-called raster line which extends in a first direction, e.g. across a page. The first direction is sometimes called the "fast scan" direction. A raster line comprises a series of dots delivered onto the printing medium by the marking elements of the printhead. The printing medium is moved, usually intermittently, in a second direction perpendicular to the first direction. The second direction is often called the "slow scan" direction.

The combination of moving the printhead relative to the printing medium while printing raster lines, and moving the printing medium relative to the printhead while not printing results in a series of parallel raster lines which are usually closely spaced. Seen from a distance, the human eye perceives a complete image and does not resolve the image into individual dots provided these dots are close enough together. Closely spaced dots of different colours are not distinguishable individually but give the impression of a blended colour determined by the amount or intensity of the different composing colours, e.g. cyan, magenta and yellow which have been applied.

In order to improve the image reproducibility of the printing method, e.g. of a straight line, it is preferred if the distance between dots of the raster is small, that is the printing has a high resolution. Although it cannot be said that high resolution always means good printing, it is true that a minimum resolution is necessary for high quality printing. A small dot spacing in the slow scan direction means a small distance between marker elements on the printhead, whereas regularly and small dot spacing in the fast scan direction places constraints on the quality of the drives used to move the printhead relative to the printing medium in the fast scan direction.

Generally, there are mechanisms for positioning a marker element in a proper location over the printing medium before it is fired. Usually, such drive mechanisms are controlled by a microprocessor, a programmable digital device such as a PAL, a PLA, an FPGA or similar although the skilled person will appreciate that anything controlled by software can also be controlled by dedicated hardware and that software is only one implementation strategy.

To be successful in the market, ink jet printing presses should combine good grey-scale capabilities, high printing speeds, and good reliability. This is not easily achievable with current prior art systems and concepts.

It is known from US-2002/0105557 to generate gradation levels or grey levels in a printed image by a combination of different sizes of printed dots. Two embodiments of printheads are described. According to a first embodiment, a printhead for a given colour comprises two head chips for that colour, and each head chip comprises a nozzle row with nozzles with different area, e.g. large and small nozzles, from which different amounts or volumes of ink are ejected. The large and small nozzles are alternately arranged in each of the nozzle rows. Furthermore, corresponding nozzles on each of the head chips, i.e. e.g. an $x^{th}$ nozzle on each of the head chips, have a different area, i.e. if the $x^{th}$ nozzle on the first head chip is a large one, the corresponding $x^{th}$ nozzle on the second head chip is a small one and vice versa.

According to a second embodiment, two head chips are provided each of which has only nozzles from which the larger or smaller ink droplet is ejected, i.e. a first head chip has all large nozzles and a second head chip has all small nozzles. The two head chips from which ink droplets of the same colour but different sizes are ejected have respective arrangements of nozzles which are offset from each other in a direction perpendicular to a scanning direction of the two head chips.

In both above embodiments, a pixel location on a printed medium is printed with either no droplet, a droplet of a small size or a droplet of a large size, different pixels together forming a superpixel having a grey level depending on the droplets actually printed. A superpixel, e.g. a 2×2 pixel matrix, using 2 levels of droplet sizes per pixelis thus built. In such 2×2 superpixels with two levels of droplet size, in theory nine distinguishable grey levels can be generated. With the above system, grey level images are printed with a resolution which is half of the resolution of the printheads, sets of two neighbouring nozzles of the head chips generating dots in one superpixel, each superpixel forming one imagepixel. The head chips for each colour ink are bonded to each other to from an integral printhead. 2×2 dot patterns disposing larger and smaller dots can be formed during a single scan operation. Obtaining grey levels this way is called dithering.

It is very difficult to make a printhead in which a marking element is suitable for printing droplets which differ in volume from each other to a large extent, e.g. a printhead marking element suitable for firing both droplets of 5 picoliter and droplets of 40 picoliter. If it is desired to make a printhead suitable for optimally printing such different droplets, such head becomes very expensive. It is a further disadvantage of the system of US-2002/0105557 that the image printed has a resolution which is only half of the resolution of the printhead. So improved grey scaling has been traded-off with resolution. Also, firing times of different drop sizes must be carefully controlled as the velocity of different drop sizes and delay before ejection of different drop sizes may be different. This is known as droplet ballistics. Due to the speed of a scanning ink jet printhead when traversing, any change in droplet velocity or delay time of ejection will result in the drops landing at a different place on the printing medium. Thus, if different drop sizes are used, the control mechanisms must be complex. For example as disclosed in U.S. Pat. No. 4,714,935 and EP 902 587, the real-time firing of each drop has to be controlled individually so that the droplets with different sizes hit the printing medium at the correct place.

For obtaining a lot of grey scale or contone levels, often a plurality of small droplets, e.g. 16, 29 or 32 small droplets, are combined to form a plurality of levels of ink load, e.g. 17, 30 or 33, see for example "Printer Handbook", M. L. Chambers, IDG books, $2^{nd}$ edition, 2000, especially chapter 3. The more ink is applied to the printing medium, the larger the size of the printed dot and the darker the image. This is called area modulated printing. However, this means that the printing device must be able to fire a small droplet of ink at a same pixel position on the printing medium a plurality of times, e.g. 16, 19 or 32 times. Such a printing device will be slower, e.g. 16, 19 or 32 times slower, than a binary printing device. Improved grey scaling has thus been traded-off with printing speed.

It is also known to do contone printing using time modulation. In that case more contone levels means reduction of the standard firing frequency, and thus also a slower printing speed.

There is a need for a method and a device for printing contone images at a speed which is higher than the speed of known contone printing devices, and with a better image quality.

SUMMARY OF THE INVENTION

It is an object of the present invention to provide an ink jet printhead and a method for printing grey scale images at high printing speed and high printing quality.

The above objective is accomplished by a method and device according to the present invention.

The present invention provides a method for printing grey scale images on a printing medium. The method comprises delivering at least a number, i.e. zero or more, of first droplets of printing material of a colour with a first volume from a first printhead and a number, i.e. zero or more, of second droplets of printing material of that colour with a second volume from a second printhead, the first volume and the second volume being different, and merging together said number of first droplets and said number of second droplets on a target pixel position on the printing medium to obtain a given greyscale dot on the printing medium. With colour is meant real colour or black/white. With grey scales or grey levels is meant colour levels of varying intensity or black/white/grey of varying intensity.

According to one embodiment, the first printhead only produces the first droplets with the first volume and the second printhead only produces the second droplets with the second volume. According to another embodiment, both the first and the second printheads produce droplets with the first volume and with the second volume, but at a pixel location where the first printhead produces a number of droplets with the first volume, the second printhead produces a number of droplets with the second volume and vice versa.

A method according to the present invention may furthermore comprise printing grey scale levels by forming a dithering pattern. Such dithering pattern may for example be a global dithering pattern, i.e. a dithering pattern applied over the complete image to be printed, e.g. in order to obtain even more grey tones. According to another embodiment, it may be a local dithering pattern, i.e. a dithering pattern applied over only part of the image, including a reduced number of pixels, e.g. in order to mask printing defects caused by defect marking elements in the printing device used for printing grey scale images.

The first and the second printhead may respectively have a first and a second intrinsic droplet frequency, being the number of times per time unit a marking element can be fired. In a method according to the present invention, a first droplet and a second droplet of printing material may be delivered at a nominal droplet frequency, the nominal droplet frequency being the slowest of the first and the second intrinsic droplet frequencies.

A nominal printing frequency may correspond to the nominal droplet frequency. The nominal printing frequency is the number of times per time unit a grey scale dot can be printed at different pixel positions. There is a relationship between nominal droplet frequency and nominal printing frequency depending on the number of droplets that need be printed with one marking element as part of one grey scale dot. According to one embodiment of the present invention, printing may be done at the nominal printing frequency. The nominal printing frequency may for example be at least 10 kHz. According to another embodiment of the present invention, printing may be done at a printing frequency that is lower than the nominal printing frequency. For example, the printing frequency may be at least 5 kHz with the maximum number of droplets that can be delivered at a pixel position by each marking element being two.

In a method according to the present invention, a number of first droplets may be printed instead of a second droplet when printing a second droplet would generate artefacts or vice versa.

The present invention also provides an ink jet printer suitable for printing grey scale images onto a printing medium. The printer comprises at least a first and a second printhead for a colour. Each printhead has a plurality of marking elements arranged in a row. The first printhead is provided for delivering first droplets of printing material of a colour with a first volume and the second printhead is provided for delivering second droplets of printing material of that colour with a second volume, the first and the second volume being different from each other. The printer also comprises a drive system to drive said at least first and second printhead with a constant frequency so that a pixel to be created from said first and second droplets is formed by merging together said first and second droplets on a target pixel position on the printing medium.

An ink jet printer may for example comprise three or more printheads for one colour. A different number of printheads may be provided for different colours.

According to an embodiment, the first printhead only produces the first droplets with the first volume and the second printhead only produces the second droplets with the second volume. According to another embodiment, both the first and the second printhead produce droplets with the first and the second volume, but so that at locations where the first printhead can produce a droplet with the first volume, the second printhead can produce a droplet with the second volume, and vice versa.

The marking elements of the first and the second printheads may have a same marking element to marking element pitch.

The first and second printheads may have an identical lay-out except for a droplet-size determining property.

Marking elements may have any suitable shape, such as circular or triangular for example. Marking elements have an area. A printhead may have a plurality of chambers each having an internal geometry. Printheads may be driven by a waveform having a shape and an amplitude. According to one embodiment, the droplet-size determining property may be the area of the marking element. According to another embodiment, the droplet-size determining property may be the internal geometry of a chamber. According to still another embodiment, the droplet-size determining property may be the shape and/or the amplitude of the driving waveform. Also a combination or optimisation of the above droplet-size determining properties may be a droplet-size determining property.

The present invention furthermore provides a method of extending printer lifetime of a printer according to the present invention. According to this method, if a marking element of a first printhead for a colour is defective, printing with this marking element is replaced by printing with a corresponding marking element from another printhead for that colour, or vice versa.

The present invention also provides a method of preventing image artefacts when printing with a printer according to the present invention. According to this method, if a marking element of a first printhead for a colour is defective, printing with this marking element is alternated with or replaced by forming a dither pattern by printing with a corresponding marking element on a second printhead for that colour, or vice versa.

These and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

DETAILED DESCRIPTION OF THE INVENTION

Figure 1:
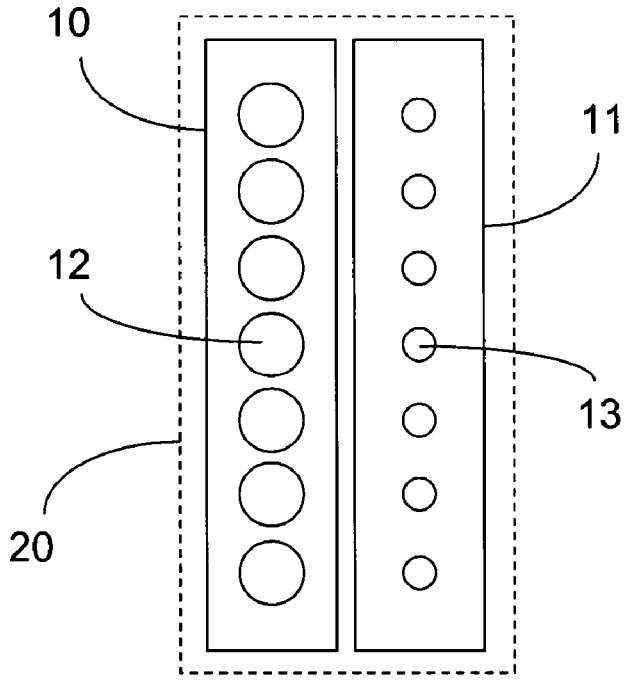
FIG. 1 illustrates a printhead assembly according to a first embodiment of the present invention, the printhead assembly comprising a first printhead with an array of nozzles having a large nozzle area and a second printhead with an array of nozzles having a small nozzle area.

The present invention will be described with respect to particular embodiments and with reference to certain drawings but the invention is not limited thereto but only by the claims. Where the term "comprising" is used in the present description and claims, it does not exclude other elements or steps.

The drawings described are only schematic and are non-limiting. In the drawings, the size of some of the elements may be exaggerated and not drawn on scale for illustrative purposes.

Figure 2:
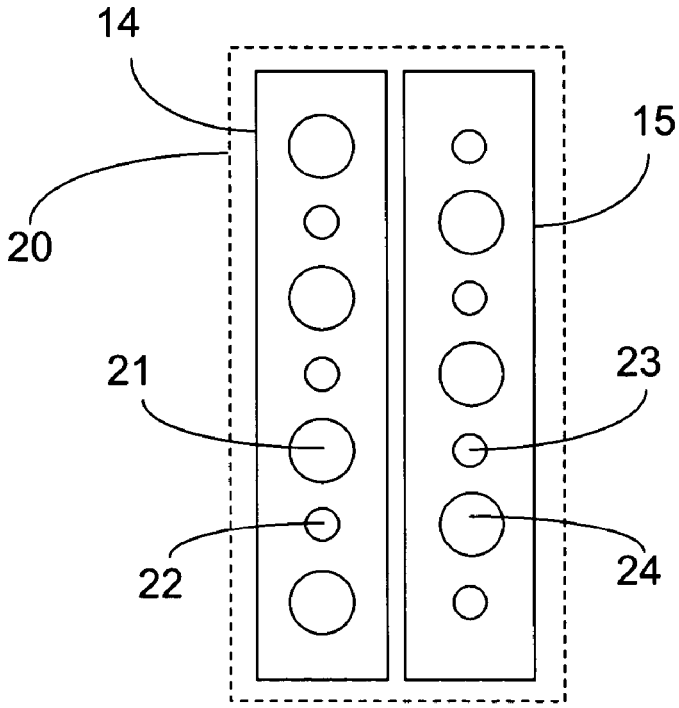
FIG. 2 illustrates a printhead assembly according to a second embodiment of the present invention, the printhead assembly comprising a first printhead with an array of nozzles, alternating nozzles with a large nozzle area and nozzles with a small nozzle area, and a second printhead with an array of nozzles, alternating nozzles with a small nozzle area and nozzles with a large nozzle area, so that on corresponding nozzle positions on the first and second printhead, the first printhead is provided with a nozzle with a large area and the second printhead is provided with a nozzle with a small area, and vice versa.

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein. The present invention will be described with reference mainly to ink-jet printing but the present invention is not limited thereto. The term "printing" as used in this invention should be construed broadly. It relates to forming markings whether by ink or other materials or methods onto a printing medium. Various printing methods which may be used with the present invention are described in the book "Principles of non-impact printing", J. L. Johnson, Palatino Press, Irvine, 1998, e.g. thermal transfer printing, thermal dye transfer printing, deflected ink jet printing, ion projection printing, field control printing, impulse ink jet printing, drop-on-demand ink jet printing, continuous ink jet printing. Non-contact printing methods are particularly preferred, however the present invention is not limited thereto. Any form of printing including dots or droplets on a medium is included within the scope of the present invention, e.g. piezoelectric printheads may be used to print polymer materials as used and described by Plastic Logic (http://plasticlogic.com) for the printing of thin film transistors. Hence, the term "printing" in accordance with the present invention not only includes marking with conventional staining inks but also the formation of printed structures or areas of different characteristics on a substrate. One example is the printing of water repellent or water attractive regions on a substrate in order to form an offset printing plate by printing. Accordingly, the term "printing medium" or "printing substrate" should also be given a wide meaning including not only paper, transparent sheets, textiles, plastics but also off-press or on-press printing plates as part of a printing process. In addition the printing may be carried out at room temperature or at elevated temperature, e.g. to print a hot-melt adhesive the printhead may be heated above the melting temperature of the adhesive. Accordingly, the term "ink" should also be interpreted broadly including not only conventional inks but also solid materials such as polymers which may be printed in solution or by lowering their viscosity at high temperatures, as well as materials which provide some characteristic to a printed substrate such as water repelling structures on the surface of the printing substrate, or binding molecules such as DNA which are spotted onto micro-arrays. Inks as used with the present invention may include water or organic solvents, and a variety of additives such as anti-oxidants, pigments and cross-linking agents. According to the present invention, a plurality of printheads is used to print grey scale or contone images at a higher speed. According to a first embodiment, as shown in FIG. 1, a plurality of printheads 10, 11 for one colour is provided in a printing device according to the present invention, said plurality of printheads forming a grey scale printhead assembly 20. Each of the printheads 10, 11 has an array or row of marking elements, e.g. nozzles 12, 13, a first printhead 10 being provided for printing droplets of a first volume or first size, and a second printhead 11 being provided for printing droplets of a second volume or second size, the first volume or size and the second volume or size being different from each other. Preferably, each head can only print one volume or size of droplet. According to a second embodiment, illustrated in FIG. 2, each of the printheads 14, 15 forming a grey scale printhead assembly 20, can print a plurality of droplet sizes, whereby printheads 14, 15 of a grey scale printhead assembly 20 are characterised in that a first printhead 14 is suitable for printing a first droplet size at a certain pixel position, while a second printhead 15 is suitable for printing a second droplet size at that same position.

The printheads 10, 11, 14 and 15 preferably have an identical lay-out, except for a droplet-size determining property. The droplet-size determining property may, according to one embodiment, for example be the nozzle area or diameter. For example the first and second printhead 10 and 11 may be provided with nozzles 12 and 13, having a same nozzle pitch, but wherein nozzles 12 have a larger area than the nozzles 13. Alternatively, the first printhead 14 may be provided with nozzles 21, 22 having alternating large and small sizes, the second printhead 15 being provided with nozzles 23, 24 also have alternating large and small sizes, but so that a large nozzle on an $x^{th}$ position of the first printhead 14 corresponds to a small nozzle on the corresponding $x^{th}$ position of the second printhead 15. The small nozzles 22 and large nozzles 21 on the first printhead 14 do not necessarily need to have the same area as the small nozzles 23 and large nozzles 24, respectively, on the second printhead 15. The droplet-size determining property may, according to a further embodiment, be also the internal geometry of the nozzle chamber. This internal geometry characterises the acoustic waves in the chamber, and thus the properties of the droplet expelled by the nozzles. Parts relating to the geometry of the chamber are, for example, its volume, the length of the electrodes, the height of the electrodes, the position of the electrodes, the position of the heating element. According to still another embodiment, the shape and/or amplitude of the driving waveform can be the droplet-size determining property. Also a combination and/or optimisation of the above droplet-size determining properties can be the droplet-size determining property.

According to an embodiment of the present invention, grey scale images are printed at the highest possible printing frequency by applying one droplet with a first size on a pixel position, or by combining a plurality of droplets with different sizes on that pixel position, whereby each droplet received on that pixel position originates from a different printhead, e.g. 10 and 11. The different droplets need to be deposited at exactly the same place, thus forming a larger dot (area modulated printing). Each printhead 10, 11 has an intrinsic maximum droplet frequency for jetting droplets of ink on the printing medium. The maximum droplet frequency of the grey scale printhead assembly 20 is then the maximum droplet frequency of the slowest printhead 10, 11. The printing frequency of the grey scale printhead assembly 20 corresponding to its maximum droplet frequency is called the nominal printing frequency of the grey scale printhead assembly 20.

According to a second embodiment of the present invention, combination of droplets from the different printheads 10, 11 may be deposited on the same pixel position, for example, up to two droplets originating from the first printhead 10 delivering droplets with a first volume or size can be combined with up to two droplets originating from the second printhead 11 delivering droplets with a second volume or size. In this case, the maximum printing frequency of the grey scale printhead assembly 20 is half of its nominal printing frequency.

For example, 3 printheads from Spectra (www.spectra-inc.com) can be used, called SL-128, SE-128 and SX-128, as first, second and third printheads. Details of those printheads can be found in the table hereunder:

| | Printhead | | |
|---|---|---|---|
| | SL-128 | SE-128 | SX-128 |
| Nozzle line length | 64.5 mm | 64.5 mm | 64.5 mm |
| Number of nozzles | 128 | 128 | 128 |
| Nozzle spacing | 508 μm | 508 μm | 508 μm |
| Nozzle diameter | 50 μm | 38 μm | |
| Calibrated drop size | 80 pl | 30 pl | 10 pl |
| Maximum droplet frequency | 30 kHz | 40 kHz | 10 kHz |

Three such printheads can be mounted in line with each other, and driven so that an $x^{th}$ nozzle at an $x^{th}$ position on the first printhead can generate a droplet at a pixel position, and that a corresponding $x^{th}$ nozzle at a corresponding $x^{th}$ position on the second or third printhead can generate a droplet at that same pixel position, the droplets originating from the first, second and third printhead having a different volume.

With three printheads as mentioned above, one of each type, the following dot sizes can be generated in a single pass, i.e. at the maximum possible or nominal printing frequency:

| SL-128 | SE-128 | SX-128 | Total volume |
|---|---|---|---|
| 0 | 0 | 0 | 0 |
| 0 | 0 | 10 | 10 |
| 0 | 30 | 0 | 30 |
| 0 | 30 | 10 | 40 |
| 80 | 0 | 0 | 80 |
| 80 | 0 | 10 | 90 |
| 80 | 30 | 0 | 110 |
| 80 | 30 | 10 | 120 |

Eight grey levels can thus be obtained at the nominal printing frequency.

With three printheads as mentioned above, one of each type, the following dot sizes can be generated if two droplets per printhead are allowed, i.e. if the printing frequency is halved:

| SL-128 | SE-128 | SX-128 | Total volume |
|---|---|---|---|
| 0 | 0 | 0 | 0 |
| 0 | 0 | 10 | 10 |
| 0 | 0 | 10 + 10 | 20 |
| 0 | 30 | 0 | 30 |
| 0 | 30 | 10 | 40 |
| 0 | 30 | 10 + 10 | 50 |
| 0 | 30 + 30 | 0 | 60 |
| 0 | 30 + 30 | 10 | 70 |
| 0 | 30 + 30 | 10 + 10 | 80 |
| 80 | 0 | 0 | 80 |
| 80 | 0 | 10 | 90 |
| 80 | 0 | 10 + 10 | 100 |
| 80 | 30 | 0 | 110 |
| 80 | 30 | 10 | 120 |
| 80 | 30 | 10 + 10 | 130 |
| 80 | 30 + 30 | 0 | 140 |
| 80 | 30 + 30 | 10 | 150 |
| 80 | 30 + 30 | 10 + 10 | 160 |
| 80 + 80 | 0 | 0 | 160 |
| 80 + 80 | 0 | 10 | 170 |
| 80 + 80 | 0 | 10 + 10 | 180 |
| 80 + 80 | 30 | 0 | 190 |
| 80 + 80 | 30 | 10 | 200 |
| 80 + 80 | 30 | 10 + 10 | 210 |
| 80 + 80 | 30 + 30 | 0 | 220 |
| 80 + 80 | 30 + 30 | 10 | 230 |
| 80 + 80 | 30 + 30 | 10 + 10 | 240 |

This means that 25 grey levels can be obtained at half the normal printing frequency. For comparison: when in a prior art printing device with one printhead per colour a combination of up to 16 small droplets is used, at $1/16^{th}$ of the normal printing frequency, i.e. $1/8^{th}$ of the printing frequency of the embodiment described with the three Spectra printheads operated at half the nominal printing frequency so as to enable to print two levels at each position with each printhead, then only 17 grey levels can be obtained. Therefore, according to the present invention, more grey levels can be obtained, at a far higher printing speed.

Furthermore, grey scale printhead assembly 20 according to the present invention provides redundancy at the nozzle level: for every nozzle there is 1 redundant nozzle in the printhead assembly. If one of the nozzles is defective, according to the present invention, a redundant nozzle can be used to mask that defect. A generally recognized problem of raster printing is the formation of artefacts, generated by a nozzle which is printing at locations where it should not print. Artefacts are caused by the digital nature of the image representation and the use of equally spaced dots. Certain artefacts such as Moiré patterns may be generated due to the fact that the printing attempts to portray a continuous image by a matrix or pattern of (almost) equally spaced dots. One source of artefacts can be errors in the placing of dots caused by a variety of manufacturing defects such as the location of the marker elements in the head or systematic errors in the movement of the printhead relative to the printing medium. In particular, if one marking element is misplaced or its firing direction deviates from the intended direction, the resulting printing will show a defect which can run throughout the printing. A variation in drop velocity will also cause artefacts when the printhead is moving, as time of flight of the drop will vary with variation in the velocity. Similarly, a systematic error in the printing medium transport may result in defects that may be visible. For example, slip between the drive mechanism for the printing medium and the printing medium itself will introduce errors. In fact, any geometrical limitation or tolerances of the printing system can be a source of errors, e.g. the length of the printhead, the spacing between marking elements, the indexing distance of the printing medium relative to the head in the slow scan direction. Such errors may result in "banding", that is the distinct impression that the printing has been applied in a series of bands. Although the errors involved can be very small, the colour discrimination, resolution and pattern recognition of the human eye are so well developed that it takes remarkably little for errors to become visible. Such artefacts can be resolved or made less visible with the use of a grey scale printhead assembly 20 according to the present invention.

For example, if a small nozzle is defective, whether it still prints but wrong, or does not print at all, not printing with the small nozzle can be compensated for with the use of its corresponding large nozzle by not printing anything for a number of times, and then printing one larger droplet. This solution is better than printing nothing at all, because it results in an approximated grey value, while printing nothing at all results in unintentional white spaces in the printed image.

Figure 3A:
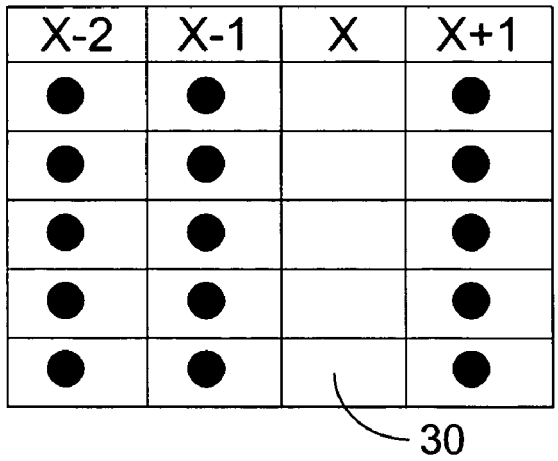
FIG. 3A illustrates printing according to the prior art, where a defect marking element on one printhead does not print.
Figure 3B:
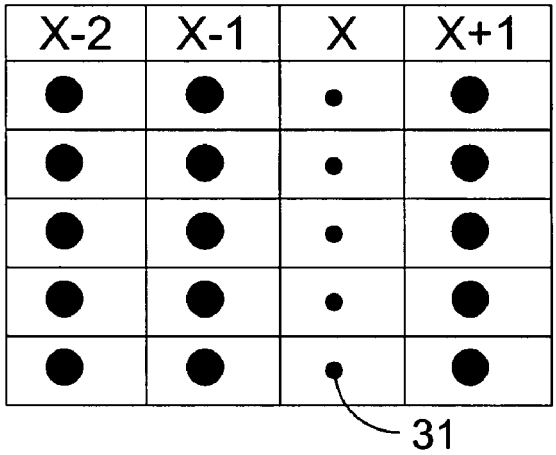
FIG. 3B illustrates printing wherein a defect marking element on a first printhead for a colour is replaced by a corresponding marking element on a second printhead for that colour.
Figure 3C:
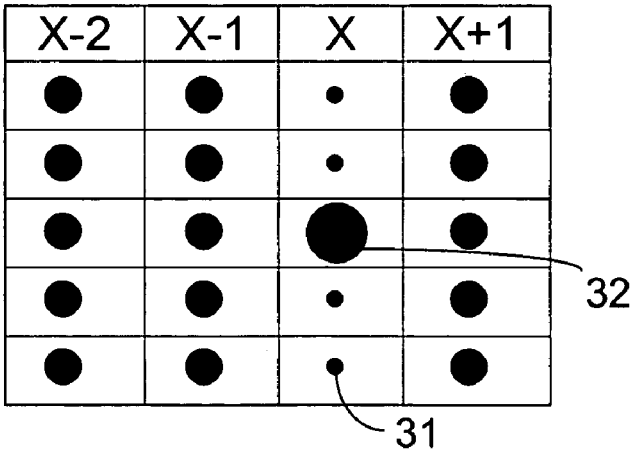
FIG. 3C illustrates printing wherein a defect marking element on a first printhead for a colour is replaced with a dither pattern formed with corresponding marking elements on a second and third printhead for that colour.

Alternatively, if for example a 30 pl nozzle is defective and does not print anymore, it is possible to use a local dithering pattern. Instead of using the 30 pl nozzle, one uses the corresponding 80 pl and 10 pl nozzles to make a dithering pattern from e.g. one 80 pl droplet and two 10 pl droplets to approximate a 30 pl droplet. With a local dithering pattern is meant a dithering pattern that is applied only locally, to alleviate the image quality degradation due to a printing defect caused by the non-printing of one of the nozzles. It may either mean to compensate a missing dot by printing another dot on that position, or it may mean to generate a dithering pattern covering also neighbouring positions. This is clarified by means of FIG. 3A to 3C. For example, a constant grey tone corresponding to single dots of 30 pl on each pixel is to be printed. In the example given in FIG. 3A, the nozzle X of the 30 pl head is defect and does not print anymore. In prior art printing, where this problem can not be solved, this would lead to a result as shown in FIG. 3A where a white stripe is formed by white pixels 30 at the locations where nozzle X of the 30 pl printhead should have been printing 30 pl pixels. If this would be solved by printing a 10 pl droplet 31, from nozzle X of the 10 pl printhead, everywhere where the defective 30 pl nozzle X, from the 30 pl printhead, should have been printing, the visual effect is much smaller but the defect is still visible as shown in FIG. 3B. According to the present invention, a local dithering pattern can be applied, for example only on the location of that white stripe. In this local dithering pattern, for example one or more 10 pl droplets 31 would be alternated with one or more 80 pl droplets 32, as illustrated in FIG. 3C. An integration of the obtained grey scale dots over the stripe which in fact was to be printed by nozzle X of the 30 pl printhead, should preferably be as close as possible to the grey scale tone corresponding to constant 30 pl printing. According to still another embodiment, not represented in the drawings, instead of applying the local dithering pattern over the stripe corresponding to the defect nozzle only, the local dithering pattern may be extended over one or more pixels which are neighbouring to that stripe. The term "neighbouring to" a reference pixel, nozzle or marking element is defined as "the distance between a neighbour and a reference being less than or equal to 3 pitches". For example a dithering pattern can be used including the pixels of the defective stripe X and their left and right neighbours X−1 respectively X+1, or the pixels of the defective stripe X and two neighbours to their left as well as two neighbours to their right. Local dithering is to be distinguished from global dithering, which is dithering applied to the whole image in order to reproduce more grey tones than can be obtained solely by use of the available grey scale levels of printhead alone, in the present invention the grey scale printhead assembly.

Local dithering may extend the useful life of a single pass printer, because one defective nozzle may be compensated for by other nozzles, and only if all nozzles which print at a certain location are defect, does a printhead need to be replaced.

Alternatively, according to the present invention, a grey tone corresponding to a 30 pl dot area may not be printed by always putting down a droplet from the 30 pl head, but rather by sometimes printing 30 pl droplets, and combining this with sometimes (on other locations on the printing medium) printing 20 pl dots and 40 pl dots, i.e. generating a dither pattern from 20 pl, 30 pl and 40 pl dots, which overall has a grey tone value of 30 pl dots. This may be very useful in a very reliable printing press, such as e.g. from Heidelberg Druckmaschine, Heidelberg, Germany or Spectra Inc., Lebanon, N.H., USA, or in a cheap thermal printer, where reliability with respect to failure of a single marking element can be improved this way, while such devices still stay cheap because the IC-technology for thermally driven printheads is cheap.

The present invention provides an improved method for generating grey tones by means of a grey scale printhead assembly 20, without the need for dithering, and leading to a better printing speed performance.

It is to be understood that although preferred embodiments, specific constructions and configurations, as well as materials, have been discussed herein for devices according to the present invention, various changes or modifications in form and detail may be made without departing from the scope and spirit of this invention. For example, the present invention can be used both for generating grey scale tones both in colour and in black/white printing. Furthermore, when doing colour printing, a grey scale printhead assembly 20 according to the present invention may be used for only some of the colours, while for the other colours another type of printhead may be used. For example in CMYK printing, a grey scale printhead assembly 20 according to the present invention can be provided for cyan, magenta and black, while for yellow another type of printhead is provided, because yellow is visually less noticeable and thus requires less yellow grey scale levels to be available.

What is claimed is:

1. A method for printing grey scale images on a printing medium, the method comprising:

delivering a first number of first droplets of printing material of a colour with a first volume from a first printhead, the first printhead having only first marking elements for delivering said first droplets of a single volume equal to said first volume, said first marking elements positioned at a fixed pitch from each other;

delivering a second number of second droplets of printing material of a second colour with a second volume from a second printhead, the first volume and the second volume being different, the second printhead having only second marking elements for delivering said second droplets of a single volume equal to said second volume, said second marking elements positioned at said same fixed pitch from each other; and depositing said first number of first droplets and said second number of second droplets at exactly the same place on a target pixel position on the printing medium to obtain a given greyscale dot on the printing medium, the method forming greyscale dots at said same fixed pitch on the printing medium.

2. A method according to claim 1, furthermore comprising a dithering step to increase the number of reproducible grey scale tones.

3. A method according to claim 1, furthermore comprising a dithering step to locally mask defects in generating a greyscale dot.

4. A method according to claim 1, the first printhead and the second printhead respectively having a first and a second intrinsic droplet frequency, a nominal printing frequency of the printing method being the lowest of the first and the second intrinsic droplet frequencies, the method further comprising printing at the nominal printing frequency.

5. A method according to claim 1, the first printhead and the second printhead respectively having a first and a second intrinsic droplet frequency, a nominal printing frequency of the printing method being the lowest of the first and the second intrinsic droplet frequencies, the method further comprising printing at a printing frequency which is lower than the nominal printing frequency.

6. A method according to claim 5, wherein the printing frequency is at least 5 kHz and the number of droplets that can be delivered at a pixel position by each printhead is at least two.

7. An ink jet printer suitable for printing grey scale images onto a printing medium, the printer comprising:

at least a first printhead and a second printhead for a colour, each printhead having a plurality of marking elements arranged in a row, the first printhead being provided for delivering only first droplets of a single volume of printing material of a first colour and the second printhead being provided for delivering only second droplets of a single volume of printing material of a second colour, the single volume of said first droplets and said second volume being different from each other, and a drive system to drive said at least first printhead and second printhead with a frequency so that a pixel to be created with said first and second droplets is formed by depositing said first and second droplets exactly on the same place on a position of said pixel on the printing medium, to form greyscale dots at a same fixed pitch on the printing medium.

8. Method of extending a printer lifetime of a printer according to claim 7, wherein if a marking element of a printhead for a specific colour is defective, printing with this marking element is replaced by printing with a corresponding marking element from another printhead for that specific colour.

9. Method of preventing image artefacts when printing with a printer according to claim 7, wherein if a marking element of a printhead for a specific colour is defective, printing with this marking element is alternated with or replaced by a dithering pattern formed by printing with a corresponding marking element on a second printhead for that specific colour.

10. Method of preventing image artefacts when printing with a printer according to claim 7, wherein if a marking element of a printhead for a specific colour is defective, a dithering pattern is used including marking elements from the printhead and from another printhead for that specific colour, the position of the marking elements used corresponding to or neighbouring the defective marking element.

* * * * *